US005638748A

United States Patent [19]

Daniel

[11] Patent Number: 5,638,748

[45] Date of Patent: Jun. 17, 1997

[54] HYDRAULIC OVERLOAD PROPORTIONAL VALVING SYSTEM FOR A MECHANICAL PRESS

[75] Inventor: Edward Daniel, Fort Loramie, Ohio

[73] Assignee: The Minster Machine Company, Minster, Ohio

[21] Appl. No.: 591,870

[22] Filed: Jan. 25, 1996

[51] Int. Cl.[6] ..... B30B 15/28

[52] U.S. Cl. ..... 100/53; 72/21.5; 72/432; 100/257; 100/282

[58] Field of Search ..... 72/19.9, 21.5, 72/432, 444, 446, 452.4, 452.5, 453.13, 455, 481.2; 100/50, 53, 257, 282

[56] References Cited

U.S. PATENT DOCUMENTS

| | | | |
|---|---|---|---|
| 2,936,055 | 5/1960 | Kassnel | 100/53 |
| 2,937,733 | 5/1960 | Danly | 100/53 |
| 3,014,420 | 12/1961 | Richter | 100/53 |
| 3,426,873 | 2/1969 | Tezuka | 100/53 |
| 3,481,171 | 12/1969 | Alexander et al. | 72/432 |
| 3,824,821 | 7/1974 | Bergmann et al. | 72/19.9 |
| 3,955,396 | 5/1976 | Carrieri | 72/432 |
| 4,166,415 | 9/1979 | Spanke et al. | 100/53 |
| 4,289,066 | 9/1981 | Proga | 100/53 |
| 4,492,154 | 1/1985 | Rupp et al. | 100/53 |
| 4,593,547 | 6/1986 | Heiberger | 72/1 |
| 4,760,781 | 8/1988 | Moriyama | 100/53 |
| 4,770,094 | 9/1988 | Schiel | 100/53 |
| 5,078,003 | 1/1992 | Oishi | 100/53 |

FOREIGN PATENT DOCUMENTS

| | | | |
|---|---|---|---|
| 283084 | 3/1966 | Australia | 100/53 |
| 0485755 | 5/1992 | European Pat. Off. | 100/53 |
| 2732278 | 1/1979 | Germany | 100/53 |
| 3810490 | 10/1989 | Germany | 100/53 |
| 60-234800 | 11/1985 | Japan | 100/53 |
| 62-3899 | 1/1987 | Japan | 100/53 |
| 3-151199 | 6/1991 | Japan | 100/53 |
| 742165 | 6/1980 | U.S.S.R. | 100/53 |
| 1027062 | 7/1983 | U.S.S.R. | 100/53 |
| 809553 | 2/1959 | United Kingdom | 100/53 |
| 1171320 | 11/1969 | United Kingdom . | |
| 1340012 | 12/1973 | United Kingdom . | |

*Primary Examiner*—Stephen F. Gerrity
*Attorney, Agent, or Firm*—Randall J. Knuth

[57] ABSTRACT

The invention pertains to a press comprising, a drive mechanism, a slide and at least two connecting rods connecting between the drive mechanism and the slide for reciprocally driving the slide. At least two fluid valves are connected to respective connecting rods and manifolded together with a hydraulic chamber disposed in or adjacent the connecting rods. An electrically adjustable proportional valve is connected to the fluid valves which operate to vary the pressure at which the fluid valves open to unload the slide. A variable system pressurizing mechanism for pressuring said chambers to a predetermined system pressure is utilized while the mechanism may unload the slide if pressure within a hydraulic chamber exceeds a predetermined system pressure. A variable relief mechanism automatically relieves pressure within the hydraulic chambers dependent on an operating state of the press.

20 Claims, 2 Drawing Sheets

HYDRAULIC OVERLOAD PROPORTIONAL VALVING SYSTEM FOR A MECHANICAL PRESS

BACKGROUND OF THE INVENTION

1. Field of the invention.

The present invention generally relates to mechanical presses and, more particularly, to a hydraulic overload relief system that remotely sets and controls the hydraulic relief pressure.

2. Description of the related art.

Mechanical presses, for example, stamping presses and drawing presses, comprise a frame having a crown and a bed and a slide supported within the frame for motion toward and away from the bed. The slide is driven by a crankshaft having a connecting rod or shutheight mechanism connected to the slide. Such mechanical presses are widely used for stamping and drawing operations and vary substantially in size in available tonnage depending upon the intended use.

In prior art presses of this type, the slide is generally connected to the crankshaft of the press drive by a connecting rod which is adjustable in length. Some systems utilize another member, such as a connection screw that is adjustable in its relationship to the slide so that the shutheight opening between the slide and the bed may be adjusted to accommodate various die sets. Disposed between these portions are chambers that are filled with pressurized hydraulic fluid at a system pressure that normally corresponds to the maximum force the press is expected to encounter during operation. During press operation, there is a necessity to limit the overall system pressure encountered by the press slide during the pressing operation to prevent damage to both the press and associated die sets. These systems to reduce or limit pressure are typically called overload systems in that they limit or prevent press overloading by exhausting the hydraulic fluid from the above-described chambers.

Prior chambers as described either were connected to pneumatic or hydraulic adjustment mechanisms to essentially disengage the slide from the drive mechanism of the press to reduce stamping pressure when the chambers were exhausted. These prior art overload systems were carried upon the slide and were subjected to stamping shock. The designs additionally had only a single large valve mounted centrally along the slide that was connected via hard pipe to the chambers within connection rods or screws. These parts would physically ride up and down along with the slide during operation. All of the previous overload systems utilized manually operated valves to control the hydraulic pressures therein.

SUMMARY OF THE INVENTION

The present invention provides for a precise control system for controlling and varying both the relief pressure and system pressure of the press.

The present invention more particularly provides a hydraulic overload system for a press including an assembly for remotely controlling both the system pressure within the slide assembly and for controlling the variable relief mechanism to automatically relieve pressure within the pressurized chambers on the slide and/or connecting rods. This is accomplished by creating a compound pressure relief valve within the slide assembly of the press including valves to exhaust the pressure chambers located therein.

The invention, in one form thereof, provides a press comprising, a drive mechanism, a slide and at least two connecting rods connecting between the drive mechanism and the slide for reciprocally driving the slide. Additionally, the invention can be used on a single point press. At least two fluid valves are connected to respective connecting rods and manifolded together. An electrically adjustable proportional valve is connected to the fluid valves which operate to vary the pressure at which the fluid valves open to unload the slide.

The invention comprises, in another form thereof, a press including a drive mechanism, a slide, and at least two connecting rods connecting between the drive mechanism and the slide. The slide is reciprocally driven by the connecting rods and said drive mechanism, while each connecting rod includes a chamber. At least two valves are connected to respective connecting rods, each valve in communication with a respective chamber and manifolded together. A variable system pressurizing mechanism is included for pressurizing the chambers, while unloading the slide when pressure within the chambers exceeds a predetermined system pressure. The press also includes a variable relief mechanism that automatically relieves pressure within the chambers dependent on an operating state of the press.

An advantage of the hydraulic overload system of the present invention is that it includes an electronically controllable proportional relief valve that allows an operator or computer to electrically change the relief setting of the hydraulic circuit anywhere from press tonnage downward. This electronic mechanism provides for a complete and total control, remotely from the slide, of the pre-set press relief pressure.

Another advantage of the present invention is that the system pressure setting of the press may be varied along with the relief pressure setting. These two pressure settings do not have to be the same pressure, nor do they need to have some type of mechanical ratio therebetween or a particular area differential between the valves therein as previously required by some hydraulic overload systems.

Yet another advantage of the present system is that the system pressurizing mechanism includes a proportional valve attached to a pressure compensated pump, to thereby provide for varying the system pressure.

Yet another advantage of the present invention is that of increased flexibility during press operation with either of the proportional control valves related to the relief or pressurizing system permitting respective changes in the relief or system pressure settings in response to any sort of input such as overpressure, press speed, part count, or other input such as from a programmable computer.

Another advantage of the present invention is that the system utilizes orifice snubbing on particular hydraulic pressure lines which snub or throttle the pressure to level particular incidental pulses along the hydraulic sensing or control lines. These orifice throttles transmit an average pressure of the system, that permits the pressure sensors to accurately sense if there is an overload condition. These orifice portions prevent the system from reading a pressure spike condition such as those that may be sensed during a dynamic shock load or snap-through force situation.

An additional advantage of the system, in one form of the present invention, is that a flow switch is disposed in the downstream lines from the hydraulic overload system to determine if any hydraulic fluid is flowing during operation. If the flow switch determines a hydraulic fluid flow is occurring, the flow switch initiates a press stop circuit to brake the press so that the entire hydraulic overload system is not totally exhausted before press stoppage.

A further advantage of the present invention is that the hydraulic overload system is separate from the actual slide. The only two components that ride up and down with the slide are a crossover manifold along with valves carried within either the connecting rods or shutheight adjustment mechanism. This provides the advantage of reducing cost in terms of reducing assembly time and eliminating equipment, while additionally removing many of the components from the slide that would be subjected to stamping shock, thereby providing a longer lifetime for those particular parts. Additionally, by mounting a majority of the parts of the hydraulic overload system to a base plate, the system of the present invention is manufactured as a subassembly assembled off of the press, thereby reducing press assembly time and including cost savings.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
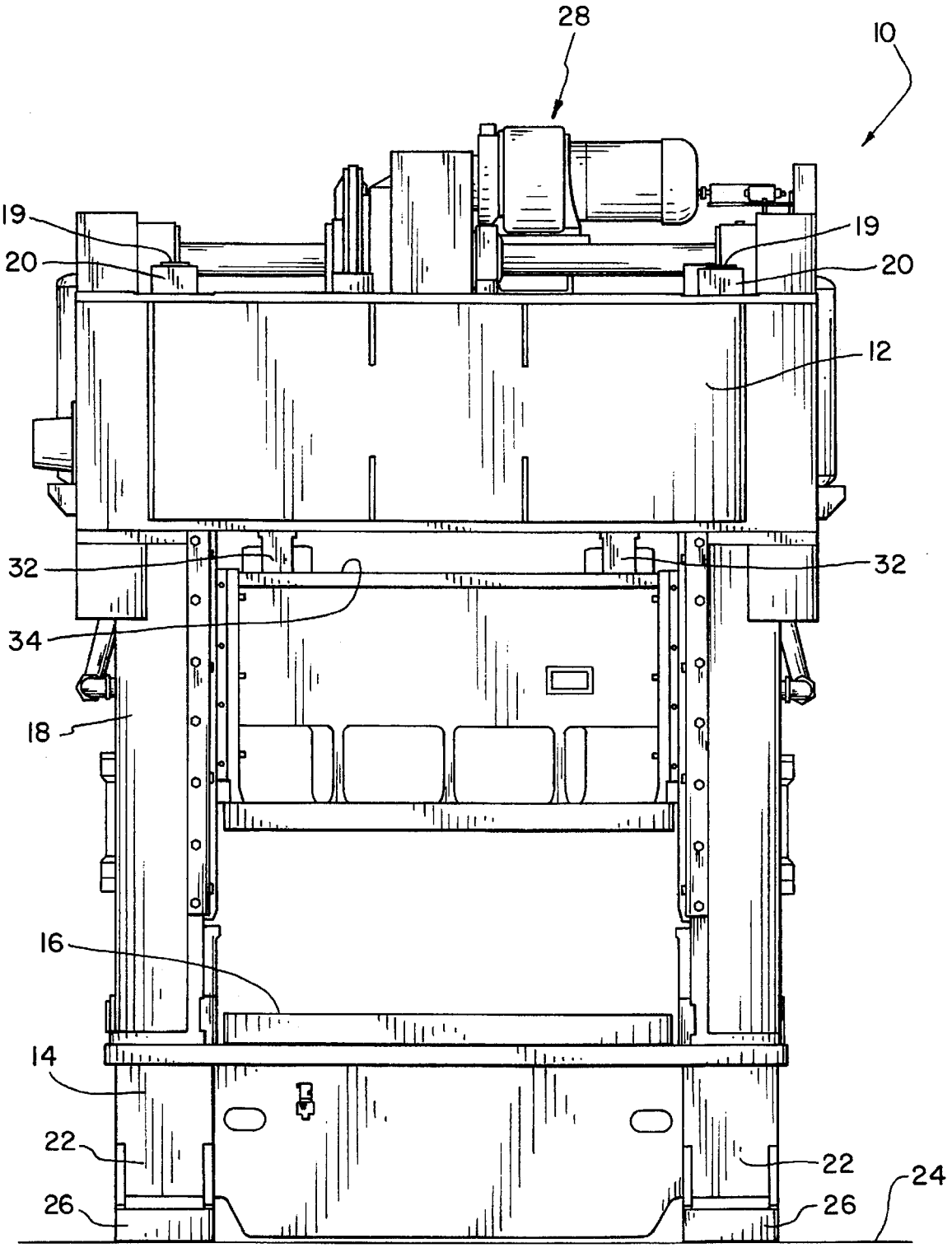
FIG. 1 is a front elevational view of a mechanical press incorporating the hydraulic overload system of the present invention.

Referring now to FIG. 1, mechanical press 10 comprises a crown assembly, such as crown 12, a bed assembly, such as bed 14 having a bolster assembly 16 connected thereto and uprights 18 connecting crown 12 with bed 14. Uprights 18 are connected to or integral with the underside of crown 12 and the upper side of bed 14. Tie rods 19 extend through crown 12, uprights 18 and bed portion 14 and are attached on each end with tie rod nuts 20. Leg members 22 are formed as an extension of bed 14 and are generally mounted on the shop floor 24 by means of shock absorbing pads 26.

A drive mechanism, such as a press drive motor 28 is attached to crown 12 of press 10 and connected by a clutch/brake mechanism (not shown) to a standard crankshaft 30 (FIG. 2) to which connecting rods 32 are attached. A slide 34 is operatively connected to connecting rods 32. During operation, drive motor 28 rotates crankshaft 30 which operates the eccentrically connected connecting rods 32 to cause slide 34 to reciprocate in rectilinear fashion toward and away from bed 14.

Figure 2:
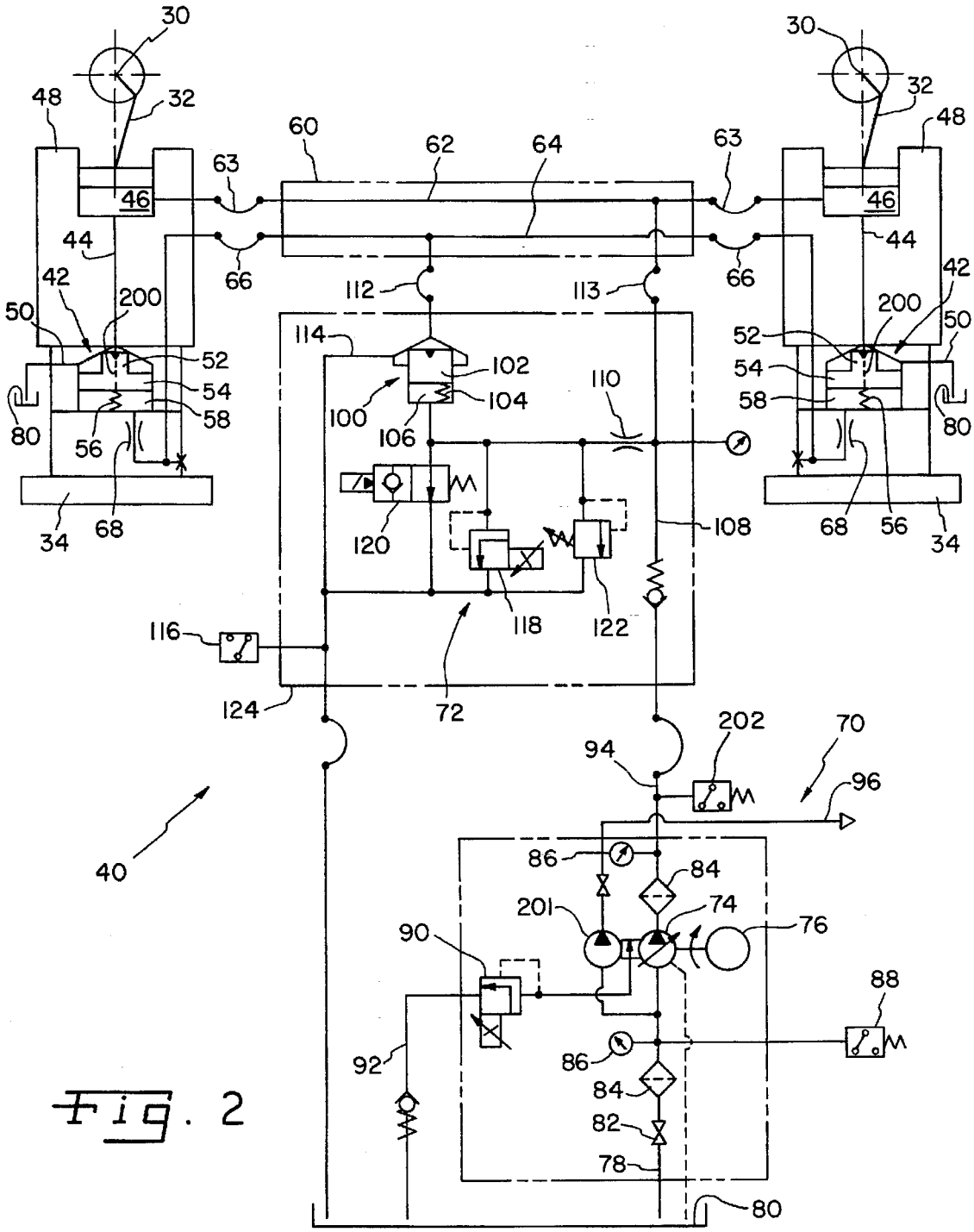
FIG. 2 is a schematic view of an embodiment of the hydraulic overload protection system of the present invention.

As shown in FIG. 2, there is illustrated in schematic form an embodiment of a hydraulic overload system 40 of the present invention. A hydraulic chamber 46 is located beneath or interior to each connecting rod 32. A plurality of fluid valves 42 are disposed or connected to connecting rods 32 and connected to chamber 46 by means of a hydraulic line 44. In one form of the invention, as shown in FIG. 2, a slide adjustment screw 48 interconnects connecting rod 32 to slide 34. In some alternate embodiments, slide adjustment screw 48 may be integrally formed with connecting rod 32. Fluid valves 42 each include a primary exit port 50 for hydraulic chamber 46. Exit port 50 is utilized to vent chamber 46 on particular over pressure conditions.

In the particular embodiment shown in FIG. 2, each connecting rod 32 is associated with a respective valve 42. Each of these fluid valves 42 may be a pressure relief valve or a cartridge valve as known in the art, including a movable sealing block 52 on a piston member 54 biased into sealing engagement by a spring 56. Together sealing block 52 and piston member 54 are the cartridge to valve 42. Beneath piston member 56 is a hydraulic chamber 58 which during use also tends to bias piston 56 to a closed position. Such a valve 42 is commercially available from Parker Hannafin Corp, Hydraulic Valve Division of Elyria, Ohio, although other valves may be utilized. Valves 42 and hydraulic chambers 46 are manifolded, i.e., connected, together via a manifold 60 carried along with or on slide 34. A first hydraulic line through manifold 60 is the system pressure line 62, while the second main line through manifold 60 is that of relief control line 64. Relief control line 64 is connected by means of flexible hydraulic lines 66 to hydraulic chambers 58 within valve 42. System pressure line 62 is connected by flexible hydraulic lines 63 to hydraulic chambers 46.

Also disposed within relief cartridge 52/54 is an orifice 200 which allows pressure to equalize between chamber 46 and 58. When there is an overload and line 64 is exhausted of pressure that holds cartridge 52/54 on its seat, flow cannot pass through orifice 200 quickly enough, due to its small size, so a pressure imbalance occurs thus forcing cartridge 52/54 off of its seat thereby allowing flow from chamber 46 to exit exhaust port 50.

Along relief control line 64 is an orifice throttle 68, used to control the flow rate of hydraulic fluid from hydraulic chamber 58. Although orifice throttle 68 is shown adjacent valve 42, it may be located at other locations on line 64. The previously recited apparatus is all contained on slide 34 and reciprocates therewith during press operation.

The hydraulic overload system 40 of the present invention utilizes two variable pressure mechanisms. The first is a variable system pressurizing mechanism 70 which generally supplies hydraulic fluid at a predefined pressure to manifold 60, chambers 46, and the other elements on slide 34. The other variable pressure mechanism is that of a variable relief mechanism 72 that automatically relieves pressure within pressure chambers 46 upon receipt of a signal.

Variable system pressurizing mechanism 70 includes a hydraulic pump 74 operated by an electric motor 76. Associated with hydraulic pump 74 is an input line 78 that obtains hydraulic fluid from a press reservoir tank 80 containing such fluid.

Input line 78 may include an integral shutoff valve 82 along with an inline hydraulic filter 84. In communication with input line 78 there may be a pressure gauge 86 to monitor the input pressure to hydraulic pump 74. Additionally, to gauge 86 there may be connected a vacuum switch 88 which is used to shut off pump 74 and prevent press 10 from operating if filter 84 is plugged.

In line with the output of hydraulic pump 74 is a proportional valve 90 that may be varied by electric or electronic signals. This proportional valve 90 includes an output line 92 directed to press reservoir 80. By varying proportional valve 90, the pressure and volume of hydraulic fluid forwarded to the rest of the overload circuit may be monitored and varied. An output line 94 connects the output of hydraulic pump 74 to both the variable relief mechanism 72 along to manifold 60, and particularly the system pressure line 62 disposed therein. Output line 94 includes a pressure gauge 86 and pressure switch 202 to indicate sufficient pressure to enable the clutch circuit. A separate branch from fixed displacement hydraulic pump 201, such as shown by line 96, provides hydraulic fluid to other elements of the press, such as the lubricating system. Although a hydraulic pump 74 is disclosed as the system pressurizing mechanism, alternate structures to supply hydraulic fluid at a variable system pressure through output line 94 are available, such as an air-over-oil pumping system.

Variable relief mechanism 72 of the present invention contains the master valve 100 which, similar to valve 42, may be of the cartridge valve type. Master valve 100 includes a piston/sealing member 102 (cartridge) axially biased by a spring 104 into a sealing engagement within the body of valve 100. A chamber 106 is formed behind piston 102 and is in hydraulic communication with the system pressure line 108 that forms a conduit for hydraulic pressure through hydraulic output line 94 to manifold 60. Between system pressure line 108 and valve 100 is an orifice throttle 110 which functions to snub or attenuate transient pressure pulses through the system.

The front or top opening of master valve 100 is in hydraulic communication by flexible hydraulic line 112 with relief control line 64 within manifold 60. Similarly, system pressure line 108 is in hydraulic communication with system pressure line 62 by flexible hydraulic line 113. Master valve 100 includes an exit port 114 that permits fluid passing therethrough to return to press reservoir 80. The combination of valves 42 with master valve 100 forms a compound valving arrangement in which master valve 100 controls the slaved valves 42.

Located along the flow path of fluid from exit port 114 is a hydraulic flow switch 116. This flow switch 116 is downstream from valve 100 so that if it senses fluid flow, it initiates a press stop circuit so that the entire hydraulic system including mechanisms 70 and 72 need not be totally exhausted before press 12 begins to brake.

Variable relief mechanism 72 includes an electrically adjustable proportional valve 118 the operation of which will be discussed below. Such a valve 118 is commercially available from Parker Hannafin Corp, Hydraulic Valve Division of Elyria, Ohio, although other valves may be utilized.

Additionally located between chamber 106 and exit port 114 is a solenoid operated normally open dump valve 120, that when deactivated, causes master valve 100 to vent fluid through exit port 114, thereby causing pressure to drop along line 112 and line 64, and connected chambers 58. Also, when an electrical power loss occurs this valve 120 will relieve pressure in the overload circuit. This loss of pressure causes pistons 54 to unseat from their valve seats, thereby causing venting of fluid located within chambers 46 and lines 44 through exit ports 50. Solenoid operated dump valve 120 is held closed electrically during press operation. This valve 120 is utilized during system testing and initial setup. Valve 120 can also be wired to other external triggering devices such as strain links on the press uprights so that the overload system can be activated by nonhydraulic inputs (for example, upright strain or stretch).

Another relief valve disposed between chamber 106 and exit port 114 is a manually operated, system overall pressure relief valve 122 which is used to manually select the maximum allowed system pressure within press 10.

In operation, prior to press actuation, the maximum system relief pressure for manifold 60 and valves 42 is manually dialed in through manually operated, system pressure overall relief valve 122. The system pressure of press 10 is selected using the variable system pressurizing mechanism 70 and particularly the electrically operated proportional valve 90. This setup during operation causes hydraulic fluid under a pressure to be transmitted through output lines 94, system pressure line 108, and thereby communicated through system pressure lines 62 to hydraulic chambers 46. Additionally this pressure is communicated down from chambers 46 down through lines 44 to one side of piston members 54, i.e., cartridge 52/54.

The variable relief pressure of the invention is set via the variable relief mechanism 72 incorporating the electrically adjustable proportional valve 118.

Operation of electrically adjustable proportional valve 118 is such that it causes an opening and venting of master valve 100 when a particular pressure is sensed through orifice throttle 110, system pressure lines 108 and 62, from chambers 46. As previously discussed, orifice throttles 110 throttle pressure changes incident to variable relief mechanism 72 to thereby give an average or actual pressure reading signal to both the electrically adjustable proportional valve 118 and the manually set, system overload pressure relief valve 122.

The flexibility created in the system by the electrically adjustable proportional valve 118 is that the relief pressure of the press may be changed at will, for instance on the installation of a new die set or on a predetermined operating state of the press determined mechanically, hydraulically, electronically, or some other way.

The operating state of the press may correspond to a pressure in the chambers 46 which exceed a predetermined relief pressure. Additionally, the operating state of the press when corresponding to an electrical signal may include inputs from associated components such as part counters, press speed monitors, strain links, and other electronic inputs that may be sensed to then electrically adjust proportional valve 118.

On opening of either of valve 118, 120, or 122, pressure is reduced within master valve chamber 106 thereby causing an unseating of piston 102 and hydraulic pressure within line 112 to vent through exit port 114. Because of the reduction of pressure through line 112 connected to control line 64, a similar pressure reduction results in hydraulic chambers 58 within valves 42. Reduction of pressure within chambers 58 causes movement of piston 54 to unseat and vent fluid within chambers 46 and lines 44 into exit ports 50 to thereby remove, i.e., unload, any pressure overload from slide 34.

The components of the variable relief mechanism 72 may be mounted upon a separate member or plate 124 that may be shock mounted to the bottom side of crown 12 or on other locations of press 10. This structure reduces part wear by exposing only manifold 60 and valves 42 to stamping shock.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a drive mechanism;

a slide;

at least two connecting rods connecting between said drive mechanism and said slide, said slide reciprocally driven by said connecting rods and said drive mechanism;

at least two fluid valves connected to respective said connecting rods, said valves connected together; and an electrically adjustable proportional valve connected to said fluid valves which operates to vary the pressure at which said fluid valves open to unload said slide.

2. The press of claim 1 in which said electrically adjustable proportional valve is not mounted to said slide.

3. The press of claim 1 further comprising a master valve connected between said at least two fluid valves and said electrically adjustable proportional valve, said master valve when vented causing said at least two fluid valves to open, said master valve not mounted to said slide.

4. The press of claim 1 further comprising a master valve connected between said at least two valves and said electrically adjustable proportional valve, said master valve when vented causing said at least two valves to vent.

5. The press of claim 4 further comprising an orifice throttle disposed between each said valves and said master valve to control the timing of valve venting between said valves and said master valve.

6. The press of claim 1 further including a flow switch that when activated by venting of said valves deactivates said drive mechanism.

7. The press of claim 1 in which said fluid valves comprise pressure relief valves.

8. The press of claim 7 in which said pressure relief valve comprise cartridge valves.

9. A press comprising:

a drive mechanism;

a slide;

at least two connecting rods connecting between said drive mechanism and said slide, said slide reciprocally driven by said connecting rods and said drive mechanism; each said connecting rod including a chamber;

at least two valves connected to respective said connecting rods, each said valve in communication with a respective said chamber, said valves manifolded together;

a variable system pressurizing mechanism for pressuring said chambers to a predetermined system pressure; and a variable relief mechanism automatically relieving pressure within said chambers dependent on an operating state of the press.

10. The press of claim 9 in which said operating state corresponds to an electric signal.

11. The press of claim 9 in which said operating state corresponds to a pressure in said chambers which exceeds a predetermined relief pressure.

12. The press of claim 11 in which said variable system pressurizing mechanism includes a flow switch that when activated, deactivates said drive mechanism.

13. The press of claim 9 in which said variable system pressurizing mechanism includes a flow switch that when activated, deactivates said drive mechanism.

14. The press of claim 9 in which said variable system pressurizing mechanism includes a hydraulic pump operated by a motor.

15. The press of claim 9 in which said variable system pressurizing mechanism includes an electrically adjustable proportional valve.

16. A hydraulic overload relieving system for use with a press having a slide reciprocated by connecting screws with internal chambers, said system comprising:

a plurality of valves disposed within said connecting screws in communication with said internal chambers; and an electrically operated proportional valve connected to said valves which operates to vary the pressure at which said valves open to vent said internal chambers.

17. The press of claim 16 further comprising a master valve connected between said plurality of valves and said electrically operated proportional valve, said master valve vented by said electrically adjustable proportional valve, thereby causing said plurality of valves to vent.

18. The press of claim 17 further comprising a flow switch in communication with said master valve, that when activated deactivates said press.

19. A press comprising:

a drive mechanism;

a slide;

at least two connecting rods connecting between said drive mechanism and said slide, said slide reciprocally driven by said connecting rods and said drive mechanism;

a fluid valve connected to said connecting rods; and an electrically adjustable proportional valve connected to said fluid valve which operates to vary the pressure at which said fluid valve opens to unload said slide.

20. The press of claim 19 further comprising a master valve connected between said fluid valve and said electrically adjustable proportional valve, said master valve when vented causing said fluid valve to open.

* * * * *

UNITED STATES PATENT AND TRADEMARK OFFICE
Certificate

Patent No. 5,638,748 Patented: June 17, 1997

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Edward Daniel, Fred Westgerdes, and Titus Broek.

Signed and Sealed this Nineteenth Day of September, 2000.

JOHN SIPOS,
*Supervisory Patent Examiner*
Art Unit 3721